US005988381A

United States Patent [19]

Ling

[11] Patent Number: 5,988,381

[45] Date of Patent: Nov. 23, 1999

[54] TOOL DISPLAY PACK WITH A SECURITY DEVICE

[75] Inventor: David Ling, Taichung, Taiwan

[73] Assignee: Hand Tool Design Corporation, Wilmington, Del.

[21] Appl. No.: 09/221,336

[22] Filed: Dec. 28, 1998

[51] Int. Cl.[6] ..... B65D 75/56

[52] U.S. Cl. ..... 206/349; 206/377; 206/471; 206/481; 206/806; 211/70.6; 220/324; 220/835

[58] Field of Search ..... 206/349, 372, 206/376, 377, 464, 806–807, 477, 481, 482; 211/60.1, 70.6; 220/835, 324, 326, 265, 266

[56] References Cited

U.S. PATENT DOCUMENTS

| | | | |
|---|---|---|---|
| 4,069,915 | 1/1978 | Schurman | 206/349 |
| 4,378,068 | 3/1983 | Bell | 206/806 |
| 4,450,961 | 5/1984 | Bies et al. | 206/349 |
| 4,634,005 | 1/1987 | Kulzer et al. | 206/349 |
| 4,711,352 | 12/1987 | Williams et al. | 206/481 |
| 4,729,473 | 3/1988 | Kulzer et al. | 206/481 |
| 5,713,467 | 2/1998 | Kao | 206/349 |

*Primary Examiner*—Paul T. Sewell
*Assistant Examiner*—J. Mohandesi
*Attorney, Agent, or Firm*—Alan Kamrath; Oppenheimer, Wolff & Donnelly, LLP

[57] ABSTRACT

A tool display pack includes a board and a security device. The board has an engaging hole with a shoulder section. The security device includes an end pivotally connected to the boar. A resilient locking member projects from an inner side of the security device that faces a front side of the board. The resilient locking member includes a hook formed on a distal end thereof and a protrusion formed adjacent to the hook. The security device includes a through-hole through which a tool to be displayed is extended. The locking member is extendible through the engaging hole of the boar such that the protrusion and the hook of the resilient locking member are located on a rear side of the board. The protrusion is releasably engaged, with the shoulder section of the board, and the hook prevents pivotal movement of the security device relative to the board when the hook is moved to bear against the shoulder section of the board, thereby locking the tool in place.

6 Claims, 7 Drawing Sheets

TOOL DISPLAY PACK WITH A SECURITY DEVICE

BACKGROUND OF THE INVENTION

1. Field of the Invention

The present invention relates to a tool display pack with a security device.

2. Description of the Related Art

U.S. Pat. No. 5,713,467 to Kao issued on Feb. 3, 1998 discloses a tool display pack having a security device. The tool display pack includes a slot in a main body for receiving a hook on a catch member, and a lock pin is extended through the catch member and the main body. The lock pin includes a flange formed on a distal end thereof and extended beyond through a hole in the main body to retain the catch member in a locked status. A tool locked by the catch member cannot be removed unless the flange is cut Nevertheless, a two-step operation is required, i.e., the hook must be inserted into the slot in the main body and then the flange is inserted through the hole in the main body, while such operation requires both hands. In addition, the security device is exposed and might affect the mood of the customers. The present invention is intended to provide an improved security device for tool display packs that mitigates and/or obviates the above problems.

SUMMARY OF THE INVENTION

It is a primary object of the present invention to provide an improved security device for tool display packs that can be locked by a single hand.

A tool display pack in accordance with the present invention includes a board and a security device. The board has an engaging hole with a shoulder section. The security device includes an end pivotally connected to the boar. A resilient locking member projects from an inner side of the security device that faces a front side of the board. The resilient locking member includes a hook formed on a distal end thereof and a protrusion formed adjacent to the hook. The security device includes a through-hole through which a tool to be displayed is extended. The locking member is extendible through the engaging hole of the boar such that the protrusion and the hook of the resilient locking member are located on a rear side of the board. The protrusion is releasably engaged with the shoulder section of the board, and the hook prevents pivotal movement of the security device relative to the board when the hook is moved to bear against the shoulder section of the board, thereby locking the tool in place.

The board may include a hang-board hole. In addition, the board may have a hole defined in a mediate section thereof through which a socket drive of a socket wrench is extended.

In an embodiment of the invention, the board has an engaging member formed on the front side thereof and surrounding the engaging hole, the engaging member forming the shoulder section. The engaging member further includes a guiding side surface for guiding the hook and the protrusion of the locking member to pass through the engaging hole.

In a preferred embodiment of the invention, the first end of the security member is pivotally connected to a lateral side of the board by a pivotal connecting means, the pivotal connecting means being substantially triangular and including two sides that engage with the first end of the locking member and the lateral side of the board, respectively.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
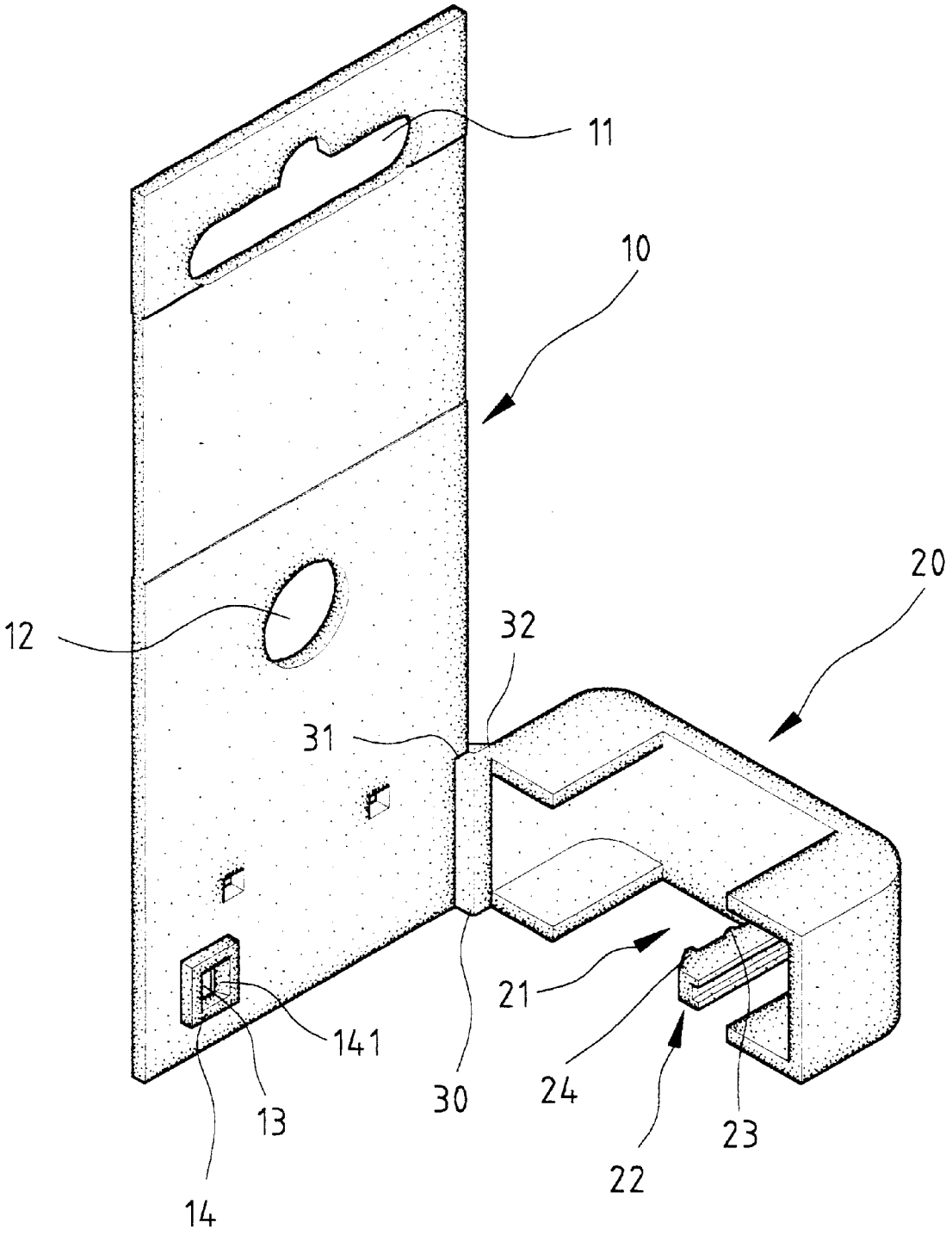
FIG. 1 is a perspective view of a tool display pack in accordance with the present invention in an opened status.
Figure 2:
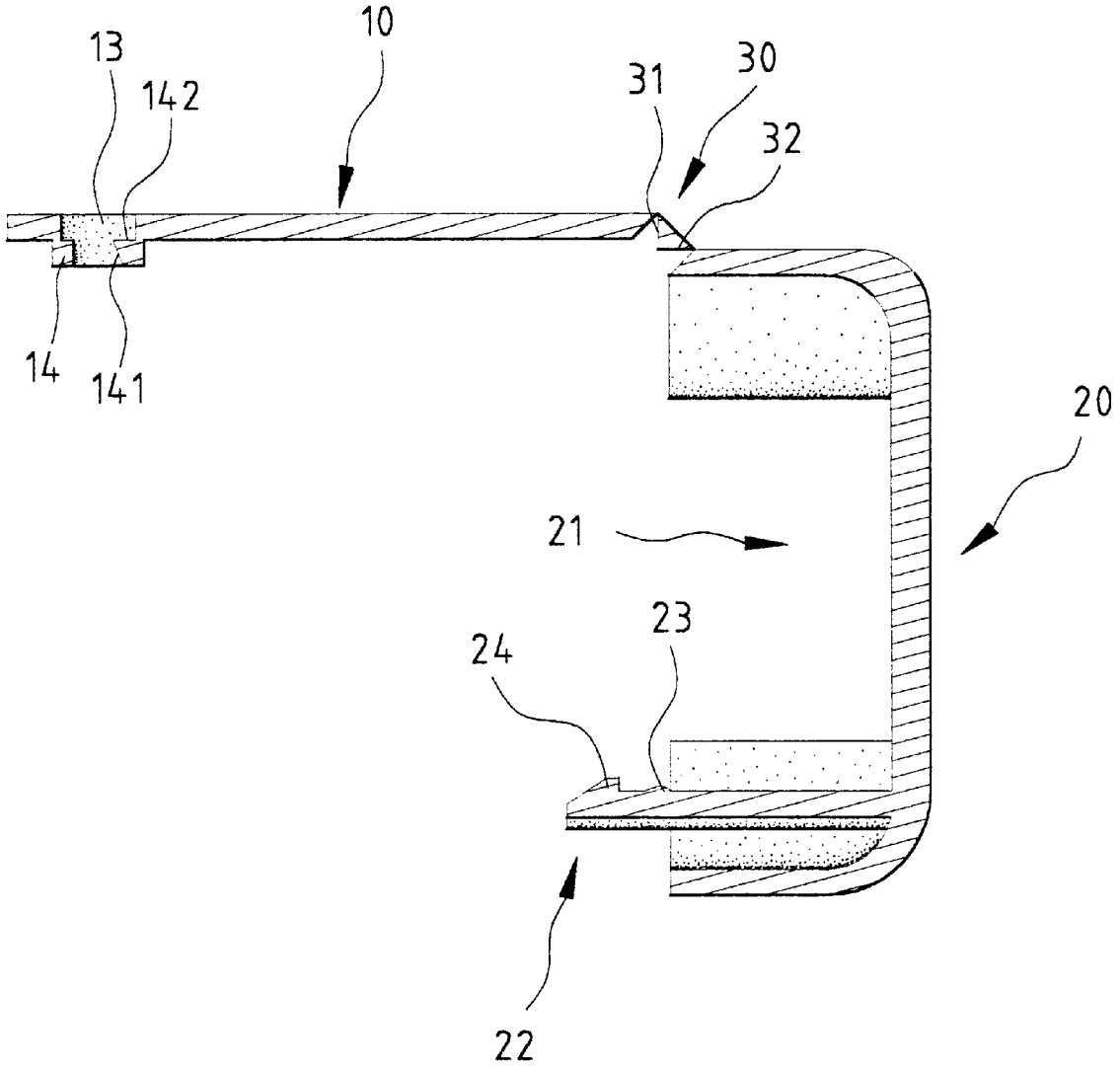
FIG. 2 is a top sectional view of the tool display pack in accordance with the present invention.
Figure 3:
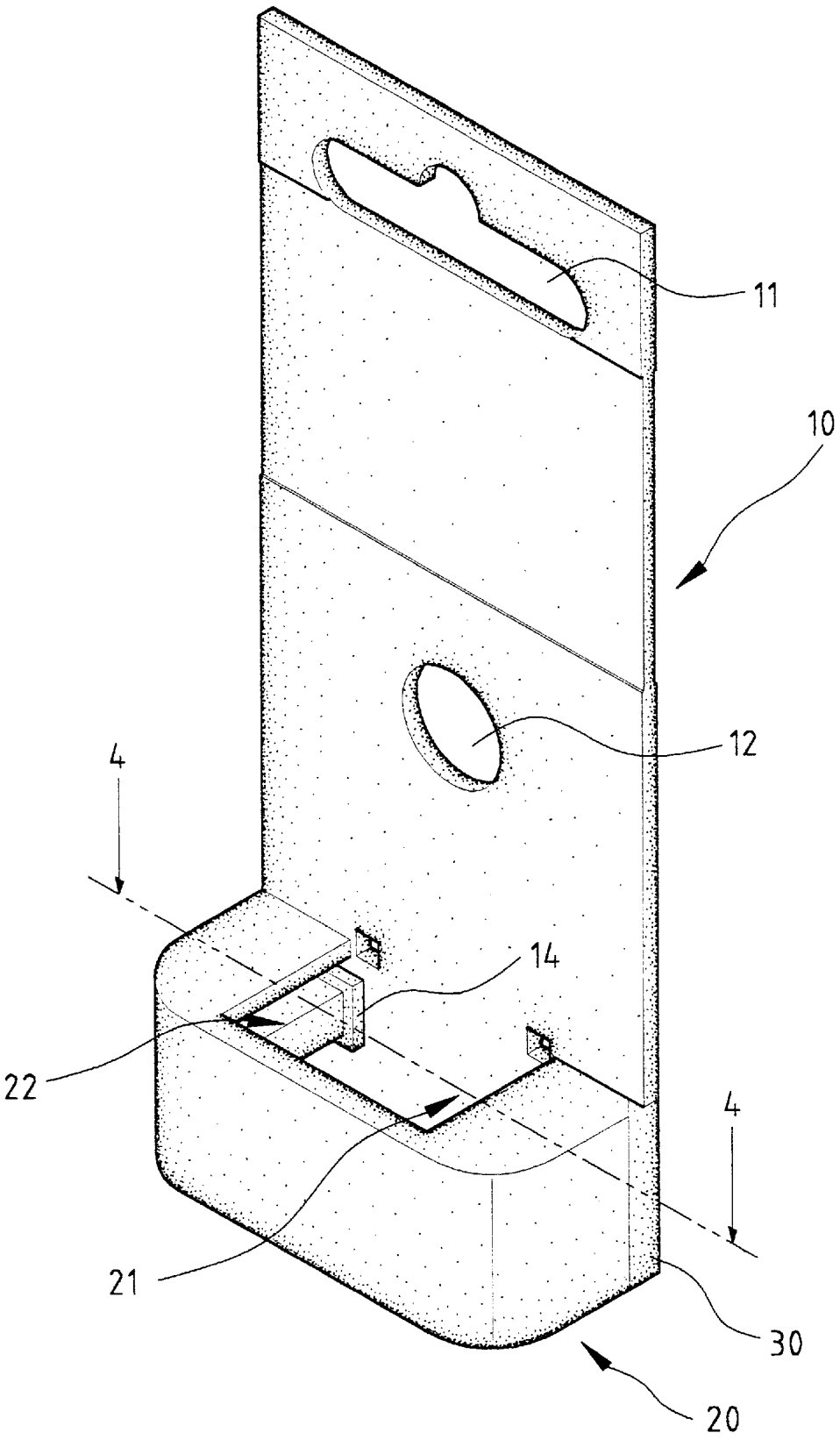
FIG. 3 is a perspective view of the tool display pack in a locked status.

Referring to the drawings and initially to FIGS. 1 to 3, a tool display pack in accordance with the present invention generally includes a board 10 having a hang-board hole 11 defined in an upper end thereof, a hole 12 defined in a mediate section thereof, and an engaging hole 13 defined in a lower end thereof. In this embodiment, an engaging member 14 is formed on a front side of the board 10 and surrounds the engaging hole 13. In addition, the engaging member 14 includes a guiding side surface 141 and a shoulder 142 that faces the engaging hole 13, as shown in FIG. 2.

Figure 4:
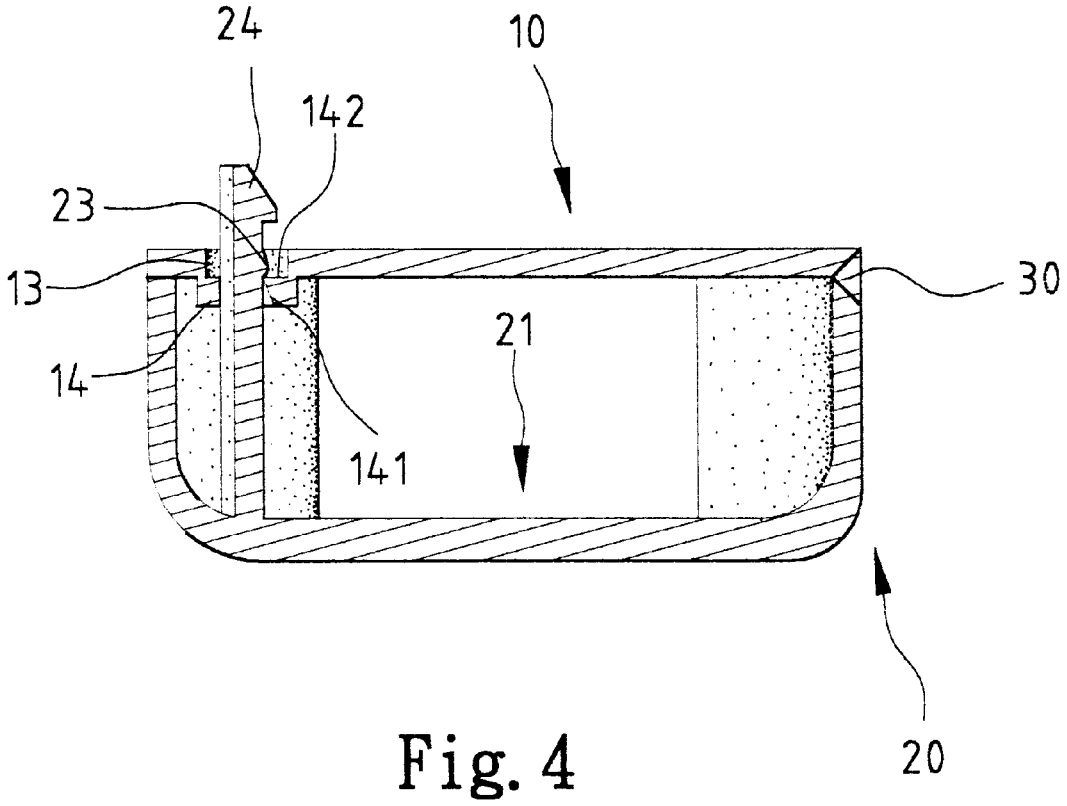
FIG. 4 is a sectional view taken along line 4–4 in FIG. 3.

A substantially U-shaped security device 20 includes a first end pivotally connected to a lateral side of the board 10 by a pivotal connecting means 30 and a second end. The pivotal connecting means 30 is substantially triangular and includes two sides 31 and 32 (FIG. 2) that engage with the first end of the security device 20 and the lateral side of the board 10, respectively when the security device 20 is in a locked status (FIG. 4). A resilient locking member 22 projects from an inner side of the security device 20 that faces the front side of the board 10 and includes a hook 24 at a distal end thereof and a protrusion 23 adjacent to the hook 24.

Figure 5:
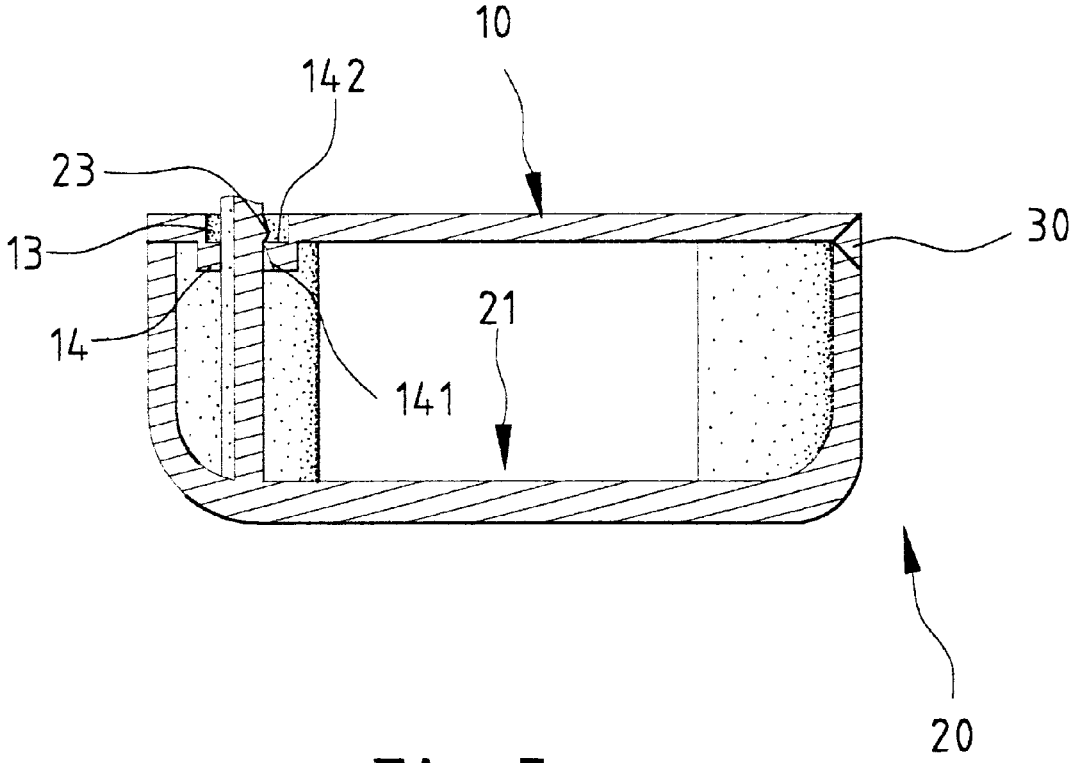
FIG. 5 is a sectional view similar to FIG. 4, in which a hook of the security device of the tool display pack is cut.
Figure 6:
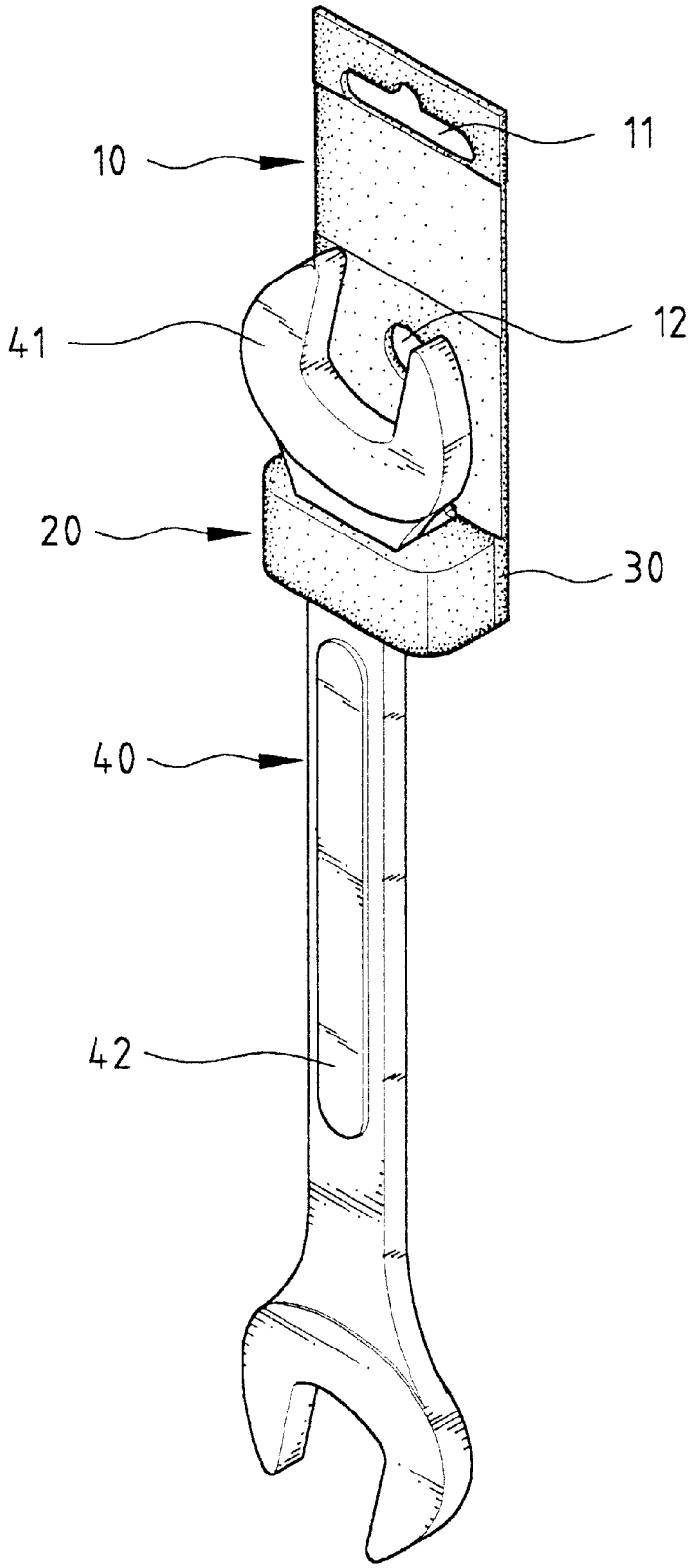
FIG. 6 is a perspective view of the tool display pack, in which a spanner is displayed and locked in place by the tool display pack.

The security device 20 in FIG. 2 is in an opened status. After extending a mediate portion 42 of a tool, e.g., a spanner 40 (see FIG. 6) through a vertical through-hole 21 in the security device 20, the security device 20 is pivoted toward the board 10 until the hook 24 and the protrusion 23 of the locking member 22 are extended through the opening 13 to the rear side of the board 10. The guiding side surface 141 of the engaging member 14 assists in smooth movement of the locking member 22. Thus, the protrusion 23 is stopped by the shoulder 142 of the engaging member 14, as shown in FIG. 4. It is appreciated that the protrusion 23 merely provides a retaining effect. A larger force may disengage the protrusion 23 from the shoulder 142 and thus allows removal of the spanner 40 if the hook 24 is cut. Yet, the hook 24, if not cut, prevents pivotal movement of the security member 20 relative to the board 10 when the hook 24 is forcibly moved to bear against the shoulder 142, thereby providing the required security. An advantage of this design is that the locking member 22 and the hole 13 are covered by the security device 20 when in the locked status. This may provide an aesthetic outline to appeal the customers. When the user wants to use the tool, he/she may cut the hook 24. as shown in FIG. 5. It is appreciated that the protrusion 23 still provides a retaining effect to retain the tool in the security device 20 (FIG. 6).

Figure 7:
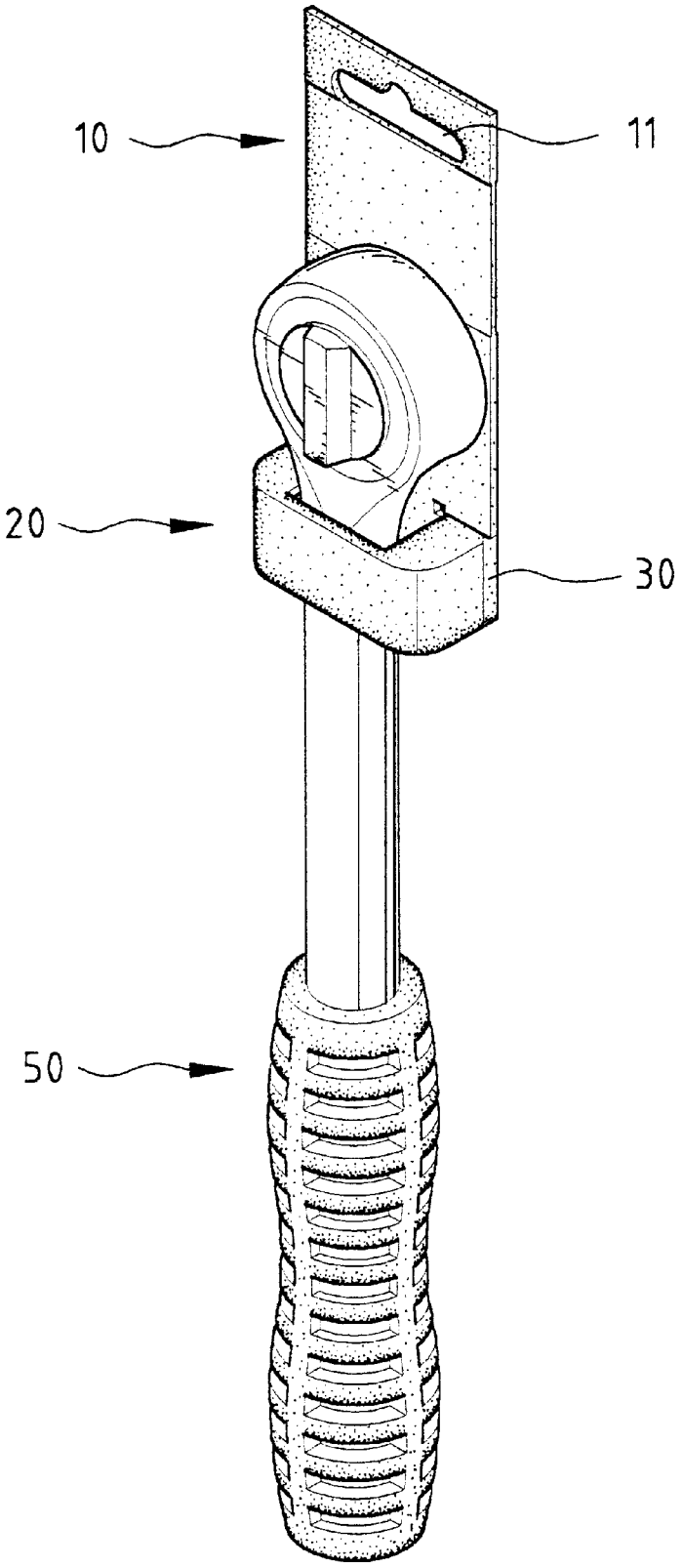
FIG. 7 is a perspective view of the tool display pack, in which a socket wrench is displayed and locked in place by the tool display pack.
Figure 8:
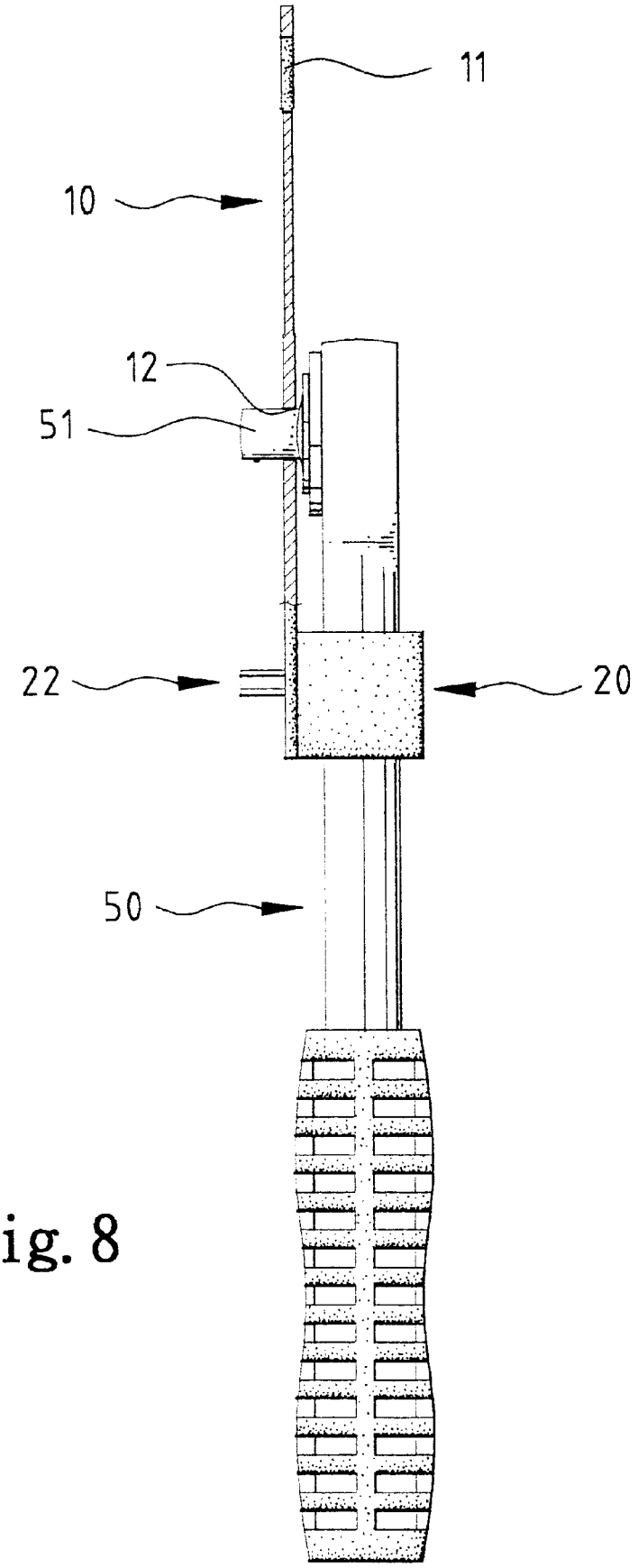
FIG. 8 is a partially sectioned side view of the tool display pack in FIG. 7.

When displaying a socket wrench 50 (FIG. 7), the socket drive 51 (FIG. 8) of the socket wrench 50 is extended through the hole 12 of the board. Thus, the tool display pack of the present invention may be used to display different tools.

Although the invention has been explained in relation to its preferred embodiment, it is to be understood that many other possible modifications and variations can be made without departing from the spirit and scope of the invention as hereinafter claimed.

What is claimed is:

1. A tool display pack comprising:

a board having an engaging hole with a shoulder section, the board further having a front side and a rear side;

a security device including a first end pivotally connected to the board and a second end, a resilient locking member projecting from an inner side of the security device that faces the front side of the board, the resilient locking member including a hook being formed on a distal end thereof and a protrusion formed adjacent to the hook, the security device including a through-hole through which a tool to be displayed is extended;

wherein the locking member is extendible through the engaging hole of the board, in which the protrusion and the hook of the resilient locking member are located on the rear side of the board, the protrusion is releasably engaged with the shoulder section of the board, and the hook prevents pivotal movement of the security device relative to the board when the hook is moved to bear against the shoulder section of the board, thereby locking the tool in place.

2. The tool display pack as claimed in claim 1, wherein the board has a hang-board hole.

3. The tool display pack as claimed in claim 1, wherein the board has a hole defined in a mediate section thereof.

4. The tool display pack as claimed in claim 1, wherein the board has an engaging member formed on the front side thereof and surrounding the engaging hole, the engaging member forming the shoulder section.

5. The tool display pack as claimed in claim 4, wherein the engaging member further includes a guiding side surface for guiding the hook and the protrusion of the locking member to pass through the engaging hole.

6. The tool display pack as claimed in claim 1, wherein the first end of the security member is pivotally connected to a lateral side of the board by a pivotal connecting means, the pivotal connecting means being substantially triangular and including two sides that engage with the first end of the locking member and the lateral side of the board, respectively.

* * * * *